US005220697A

United States Patent [19]

Birchfield

[11] Patent Number: 5,220,697

[45] Date of Patent: Jun. 22, 1993

[54] HANDLE ASSEMBLY FOR SHOWER NOZZLE ASSEMBLY

[76] Inventor: William T. Birchfield, 4312 Wallace Neel Rd., Charlotte, N.C. 28208

[21] Appl. No.: 787,018

[22] Filed: Nov. 4, 1991

[51] Int. Cl.[5] ..... A47K 3/00

[52] U.S. Cl. ..... 4/559; 4/604; 4/605; 16/114 R; 292/DIG. 2; 74/544

[58] Field of Search ..... 4/559, 567, 568, 570, 4/604, 605; 16/114 R, 115, 121, DIG. 24, DIG. 25, DIG. 30; 239/280, 282, 578; 292/336.3, 347, DIG. 2; 251/291, 292, 293; 74/523, 544

[56] References Cited

U.S. PATENT DOCUMENTS

| | | | |
|---|---|---|---|
| 1,262,425 | 4/1918 | Young | 74/544 |
| 1,285,351 | 11/1918 | Parsons | 74/544 |
| 2,043,418 | 6/1936 | Newmark | 251/291 X |
| 2,238,513 | 4/1941 | Ward | 292/347 |
| 2,726,303 | 12/1955 | Berndsen | 74/544 X |
| 3,540,694 | 11/1970 | Cornelius | 251/292 X |
| 3,827,739 | 8/1974 | Overholser | 292/347 |
| 4,273,289 | 6/1981 | Jette | 239/578 X |
| 4,285,536 | 8/1981 | McCoy et al. | 292/336.3 |
| 4,397,489 | 8/1983 | Lind | 292/347 |
| 4,398,668 | 8/1983 | Jette | 4/604 X |

FOREIGN PATENT DOCUMENTS

| | | | |
|---|---|---|---|
| 0855368 | 5/1940 | France | 4/570 |
| 2644813 | 9/1990 | France | 4/568 |

*Primary Examiner*—Henry J. Recla
*Assistant Examiner*—Robert M. Fetsuga
*Attorney, Agent, or Firm*—W. Thad Adams, III

[57] ABSTRACT

A handle assembly for a shower nozzle assembly having a slide bar for being vertically mounted on the wall in a bath, a shower nozzle slidably mounted on the slide bar and a clamp for releasably clamping the shower nozzle in a predetermined adjustment position along the length of the slide bar. The handle assembly includes an elongated handle positioned on the clamp. The handle assembly makes it easy for the shower nozzle to be adjusted by a person seated in a position where the clamp itself cannot be grasped by the person to loosen the shower nozzle and permit adjustment of the height of the shower nozzle.

7 Claims, 4 Drawing Sheets

HANDLE ASSEMBLY FOR SHOWER NOZZLE ASSEMBLY

TECHNICAL FIELD AND BACKGROUND OF THE INVENTION

This invention relates to a handle assembly intended for use by handicapped persons. Many shower bath stalls, particularly those intended for use by handicapped persons, now include a vertical slide bar which permit adjustment of the shower nozzle. However, many handicapped persons, once seated in the bath, cannot reach the shower nozzle to adjust it vertically, thus largely defeating purpose of the adjustable shower nozzle assembly.

The handle assembly according to the invention comprises a simple way of providing easy adjustment of the height of the shower nozzle assembly by one seated well below or some distance from the shower nozzle assembly.

The handle assembly according to the invention is adaptable for either retrofit to an existing shower nozzle assembly or for new shower nozzle assemblies when made.

SUMMARY OF THE INVENTION

Therefore, it is an object of the invention to provide a handle assembly which permits an adjustable shower nozzle assembly to be easily adjusted by a handicapped person.

It is another object of the invention to provide a handle assembly which can be retrofitted to existing shower nozzle assemblies.

It is another object of the invention to provide a handle assembly which can be applied to new shower nozzle assemblies when made.

These and other objects of the present invention are achieved in the preferred embodiments disclosed below by providing in a shower nozzle assembly having a slide bar for being vertically mounted on the wall in a bath, a shower nozzle slidably mounted on the slide bar and a clamp for releasably clamping the shower nozzle in a predetermined adjustment position along the length of the slide bar, the improvement comprising an handle assembly including an elongated handle positioned on the clamp. The handle assembly makes it easy for the shower nozzle to be reached and adjusted by a person seated in a position where the clamp itself cannot be grasped by the person to loosen the shower nozzle and permit adjustment of the height of the shower nozzle.

According to one preferred embodiment of the invention, the handle assembly includes a cover for being fitted over and secured to the clamp for movement with the clamp.

According to another preferred embodiment of the invention, the handle is curved to permit being easily grasped by the person by placing the hand behind the handle while the handle is in all positions including a position where the end of the handle is in a position to adjacent the wall.

According to yet another preferred embodiment of the invention, the handle includes an enlarged knob on one end thereof.

According to one preferred embodiment of the invention according to an alternative embodiment, a handle assembly is provided which includes an elongated handle for being positioned on a clamp holding a shower nozzle on a vertical bar vertically mounted on the wall of a bath for being grasped by a person seated in a position where the clamp itself cannot be grasped by the person to loosen the clamp and permit adjustment of the height of the shower nozzle.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
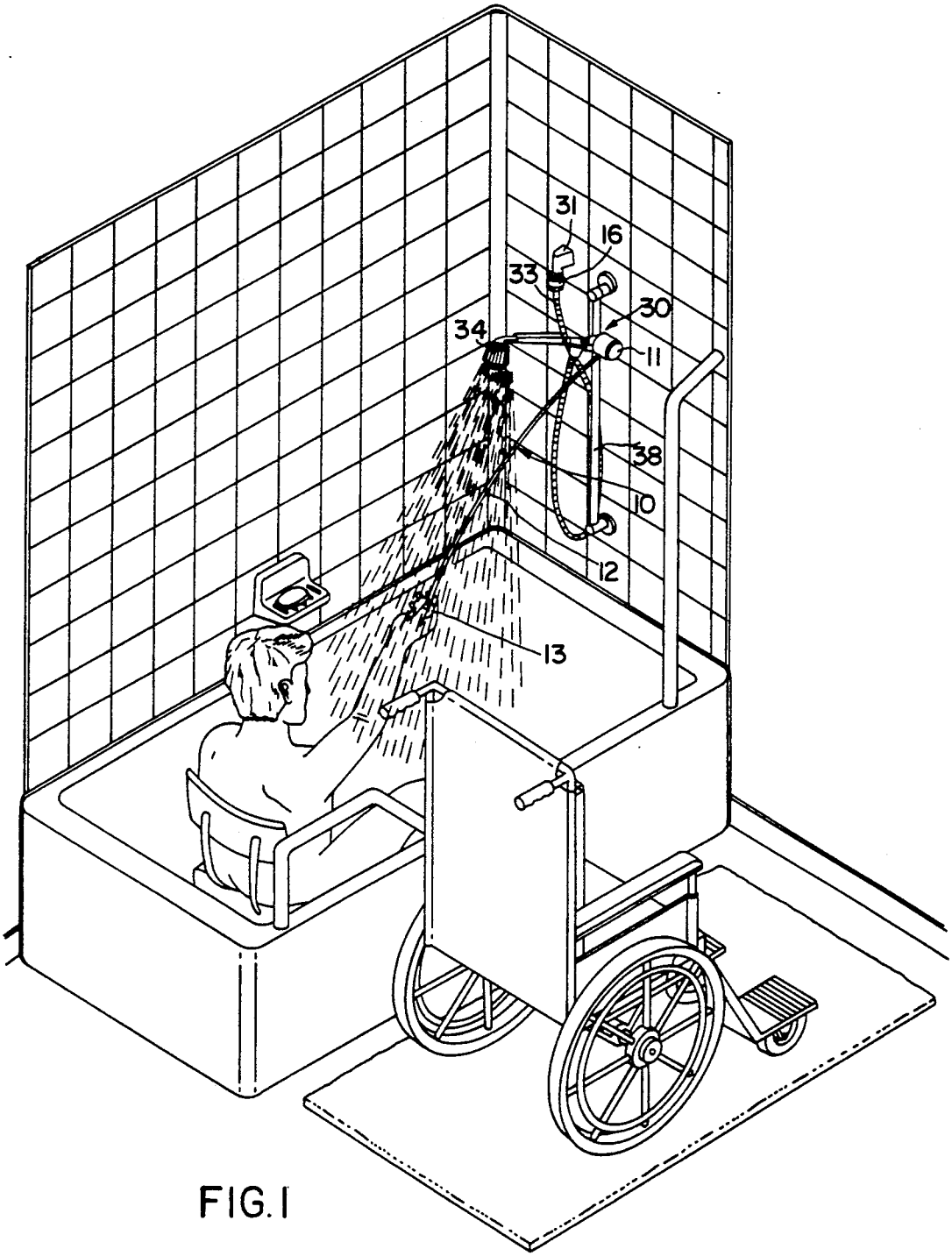
FIG. 1 is a perspective view of a bath which includes the handle assembly invention according to the embodiment described in the application.
Figure 2:
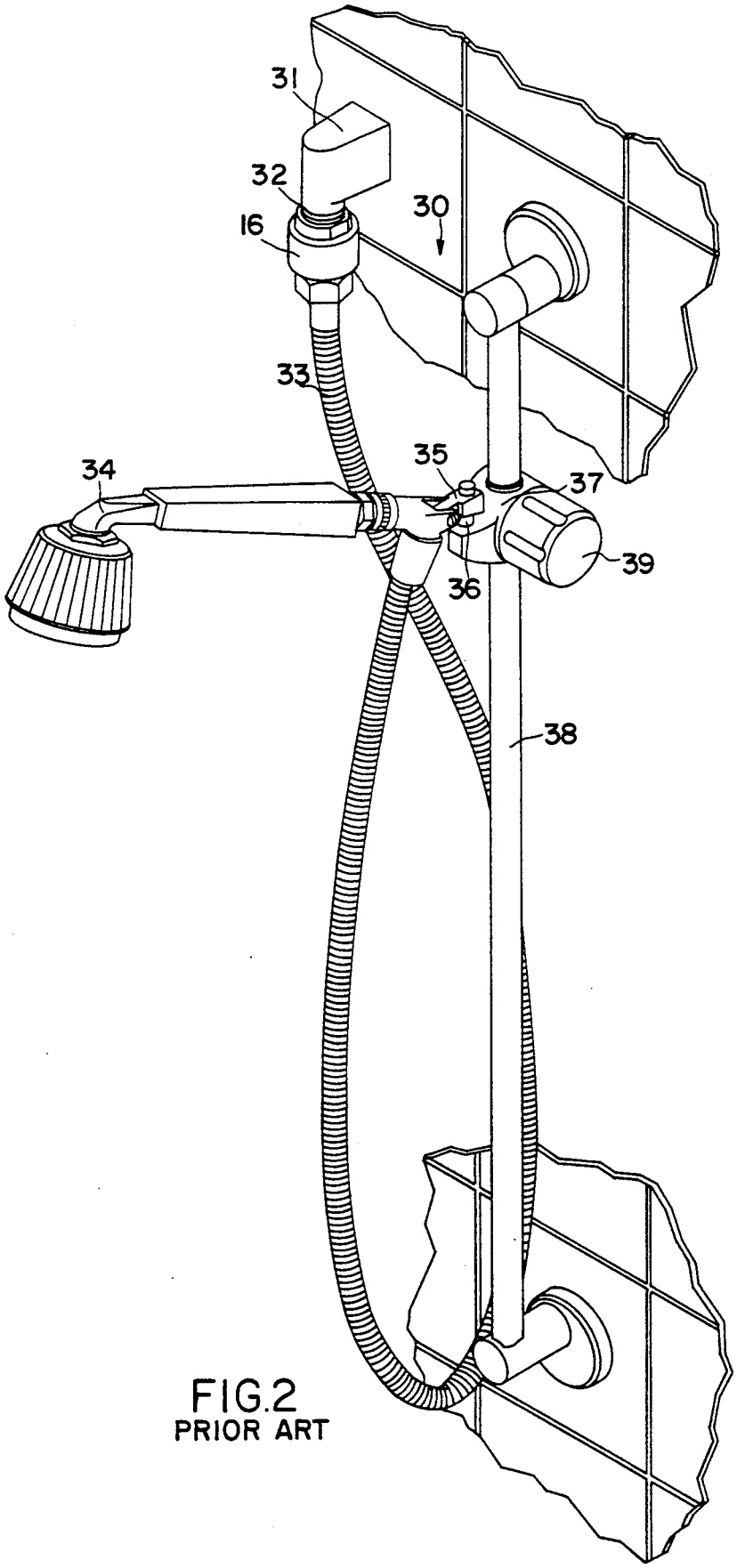
FIG.2 PRIOR ART
FIG. 2 is an enlarged perspective view of a shower nozzle assembly according to the prior art.

Referring now specifically to the drawings, a handle assembly according to the present invention is illustrated in FIG. 1 and shown generally at reference numeral 10. The handle assembly 10 is used in conjunction with a conventional shower nozzle assembly 30. As is best shown in FIG. 2, the prior art shower nozzle assembly 30 includes a water supply coupling 31 which is connected to a water supply which extends through the wall of the shower or tub enclosure (not shown). The water supply coupling 31 includes a threaded male coupling 32. An elongate flexible hose 33 includes a threaded vacuum breaker 16 which connects to the male coupling 32. The other end of the hose 33 is connected to a hand held shower nozzle 34. The shower nozzle 34 includes a bracket 35 which is pivoted to the shower nozzle 34, and which is received on a stud 36. Stud 36 is mounted on the upper surface of a slide 37 which is mounted on a vertically-mounted bar 38. The bar 38 is mounted on the wall of a shower stall. The slide 37 slides along the vertical bar 38 and can be tightened at a desired vertical position by turning a clamp 39. Referring again to FIG. 1, a cup-shaped cover 11 is provided to fit over the clamp 38. A handle 12 is connected to cover 11. The handle 12 is positioned to extend downwardly towards a patient who might be seated in a tub below the shower nozzle 34. The cover 11 is fastened to the clamp 39 by a set screw 40.

Once the shower nozzle 34 is lowered by the patient to within reach, the patient can grasp the shower nozzle 34, remove it from the stud 36 and manipulate it to thoroughly cleanse the body.

Figure 3:
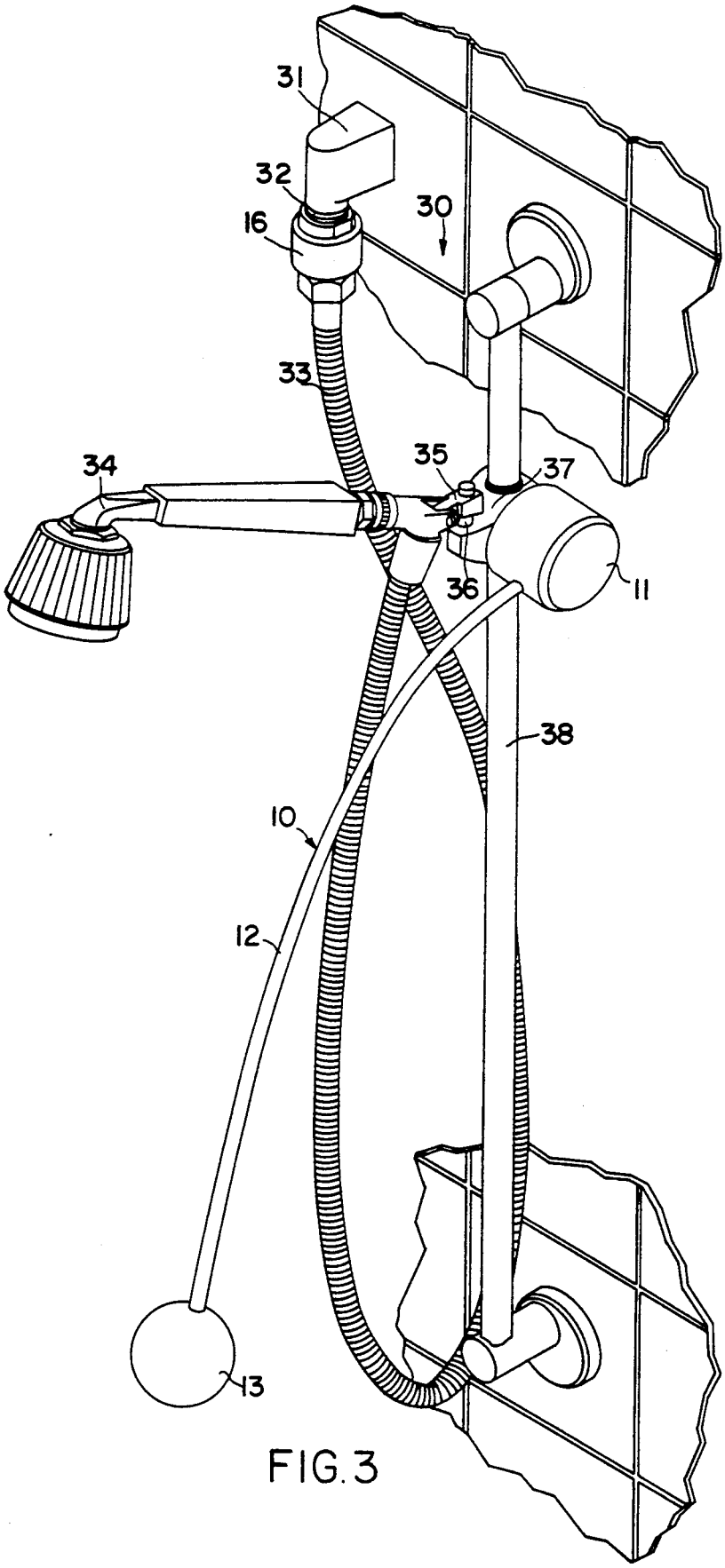
FIG. 3 is an enlarged perspective view of a shower nozzle assembly including a handle assembly according to an embodiment of the invention.
Figure 4:
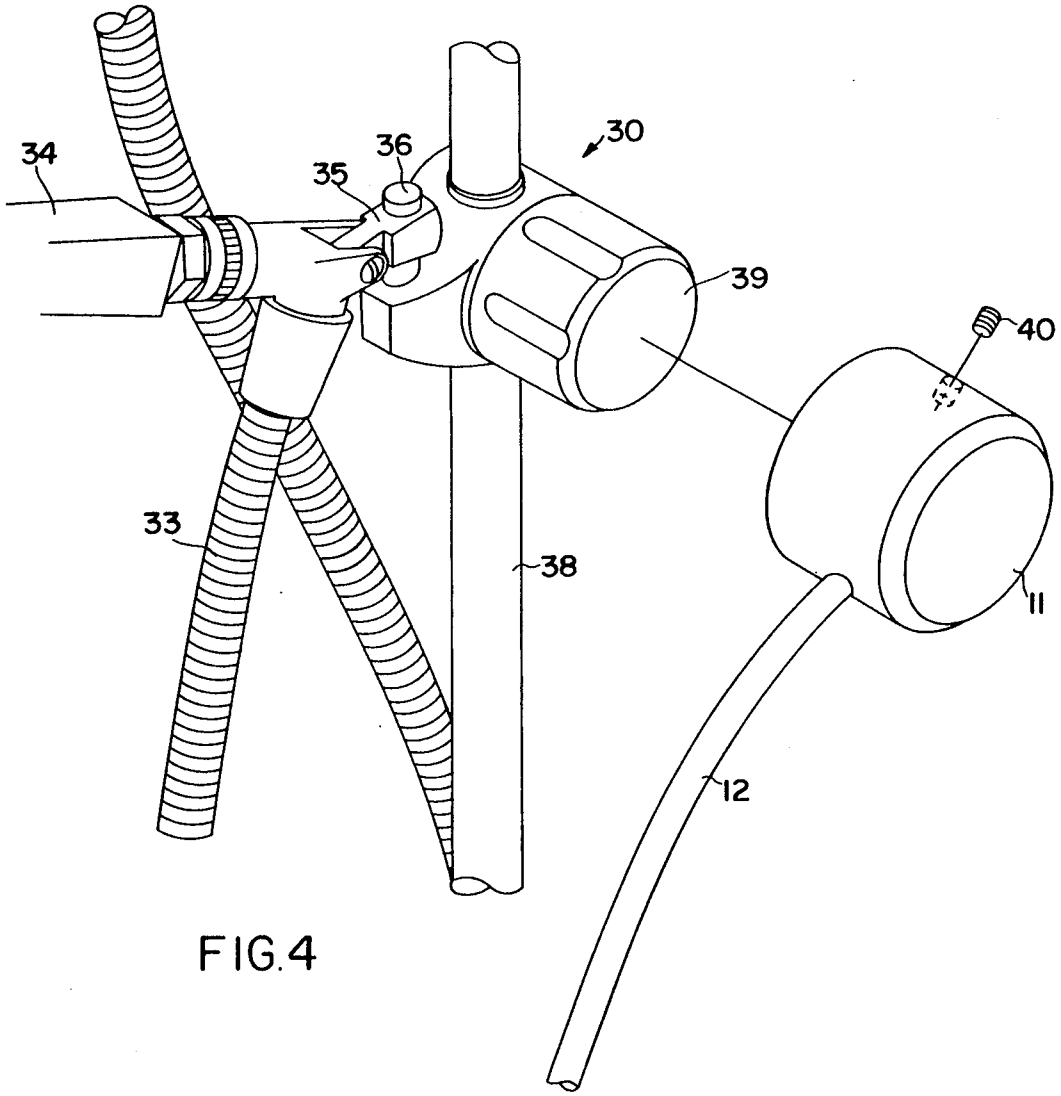
FIG. 4 is an enlarged perspective view of an embodiment of the handle assembly which can be retrofitted onto an existing shower assembly.

The handle assembly 10 of FIG. 1 is shown more clearly in FIGS. 3 and 4. Handle assembly 10 includes a ball-shaped knob 13 which aids in manipulating handle 12.

As is best shown in FIG. 3 handle 1 is preferably bent into a curved shape. This permits the handle 12 to be manipulated whereby the knob 13 can be moved substantially into contact with the wall of the shower or tub enclosure. The handle 12 along its length is spaced-apart from the wall so that a hand can be easily passed behind the handle 12 and grasped. This embodiment is intended for being retrofitted onto an existing shower nozzle assembly.

In accordance with another embodiment of the invention the handle 12 can be attached directly to the clamp 39 and manipulated in the same manner. In either case the handle 12 is preferably chrome-plated metal of the general type used in bathroom facilities. The length of the handle 12 can vary as required depending on the height on the wall that the shower nozzle assembly 10 is mounted on the wall. An appropriate length for most circumstances is between 18 inches and 24 inches.

A handle assembly for a shower nozzle assembly is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a shower nozzle assembly having an elongate slide bar for being vertically mounted on the wall in a bath, a shower nozzle slidably mounted on said slide bar and a clamp mounted on said shower nozzle and cooperating with said slide bar for releasably clamping said shower nozzle in a predetermined vertical adjustment position along the length of the slide bar, the improvement comprising a handle assembly including an elongated handle positioned on said clamp for being grasped by a person seated in a position where the clamp itself cannot be grasped by the person to loosen the shower nozzle and permit adjustment of the height of the shower nozzle and to tighten the shower nozzle in the desired position, wherein said handle assembly includes a cover fitted over and secured to the clamp for movement with the clamp as it loosens and tightens the shower nozzle.

2. In a shower nozzle according to claim 1, wherein said handle is curved to permit being easily grasped by the person by placing the hand behind the handle while the handle is in all positions including a position where the end of the handle is in a position to adjacent the wall.

3. In a shower nozzle according to claim 1, wherein said handle includes an enlarged knob on one end thereof.

4. In a shower nozzle assembly having an elongate slide bar for being vertically mounted on the wall in a bath, a shower nozzle slidably mounted on said slide bar and a clamp mounted on said shower nozzle and cooperating with said slide bar for releasably clamping said shower nozzle in a predetermined vertical adjustment position along the length of the slide bar, said clamp including a rotatable knob for being grasped and turned in one direction to loosen the shower nozzle on the vertical slide for vertical adjustment, and rotated in the other direction to tighten the shower nozzle on the vertical slide at the desired location, the improvement comprising a handle assembly including an elongated handle positioned on said rotatable knob for unison movement therewith, said elongated handle extending outwardly and downwardly in a direction for being grasped by a person seated in a position where the knob itself cannot e grasped by the person to loosen the shower nozzle and permit adjustment of the height of the shower nozzle and to tighten the shower nozzle in the desired position.

5. In a shower nozzle according to claim 4, wherein said handle assembly includes a cover fitted over and secured to the knob of the clamp for movement with the clamp as it loosens and tightens the shower nozzle.

6. In a shower nozzle according to claim 4, wherein said handle is curved to permit being easily grasped by the person by placing the hand behind the handle while the handle is in all positions including a position where the end of the handle is in a position to adjacent the wall.

7. In a shower nozzle according to claim 4, wherein said handle includes an enlarged knob on one end thereof for being grasped by the person as the handle is manipulated.

* * * * *